US005316216A

United States Patent [19]

Cammack et al.

[11] Patent Number: 5,316,216

[45] Date of Patent: May 31, 1994

[54] SHOWERHEAD

[75] Inventors: Michael A. Cammack; Michael W. Koliha; David W. Smith, all of Fort Collins, Colo.

[73] Assignees: Teledyne Industries, Inc.; Teledyne Water Pik, Fort Collins, Colo.

[21] Appl. No.: 988,434

[22] Filed: Dec. 9, 1992

Related U.S. Application Data

[63] Continuation-in-part of Ser. No. 747,742, Aug. 20, 1991, abandoned.

[51] Int. Cl.[5] ..... B05B 1/08; B05B 1/18

[52] U.S. Cl. ..... 239/71; 239/381; 239/447; 239/449; 239/600

[58] Field of Search ..... 239/436–449, 239/381, 553.5, 71, 600, 553.3, 554, 553

[56] References Cited

U.S. PATENT DOCUMENTS

| | | | |
|---|---|---|---|
| 1,890,156 | 12/1932 | König | 239/554 |
| 2,671,693 | 3/1954 | Hyser et al. | 239/553 |
| 3,344,994 | 10/1967 | Fife | 239/457 |
| 4,068,801 | 1/1978 | Leutheuser | 239/381 |
| 4,330,089 | 5/1982 | Finkbeiner | 239/449 |
| 4,398,669 | 8/1983 | Fienhold | 239/449 |
| 4,588,130 | 5/1986 | Trenary et al. | 239/449 |
| 4,629,125 | 12/1986 | Liu | 239/443 |

FOREIGN PATENT DOCUMENTS

| | | | |
|---|---|---|---|
| 563459 | 5/1957 | Italy . | |
| 2199771 | 7/1988 | United Kingdom | 239/447 |

*Primary Examiner*—Karen B. Merritt
*Attorney, Agent, or Firm*—Hugh H. Drake

[57] ABSTRACT

A showerhead is either wall mounted or provided with a handle connected through a flexible hose to an incoming water outlet. The showerhead has a turbine which may cause the delivery of pulses of circumferentially distributed groups of pulses of water so as to provide either fast or slow massage action. Also included is a pause mode in which flow is reduced without complete shutoff and a center spray mode which provides a concentrated spray pattern. Other modes possible are a needle spray, a combination pulse and needle spray, a combination needle spray with a body spray, just a body spray, and an oval shape spray pattern. Various water paths are defined from a flow selector through the unit to different ones of front-facing orifices as defined for the different modes. Selection is achieved by a combination of a flow director and a control plate. User access for mode selection is by way of an external circumferential control ring operatively coupled to the control plate through a control arm. A component is removable by the user to enable easy cleaning of an array of the outlet orifices.

13 Claims, 11 Drawing Sheets

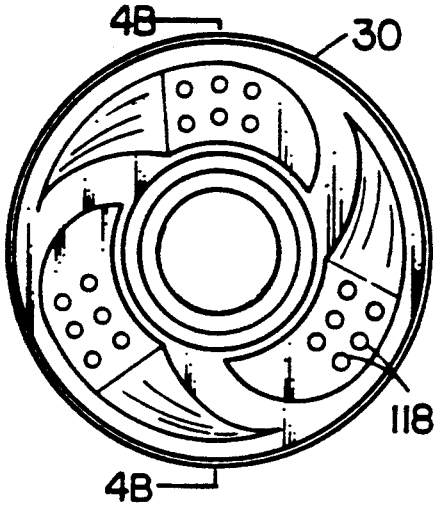
FIG. 4A
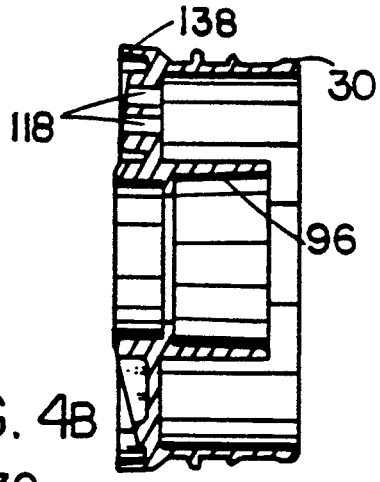
FIG. 4B
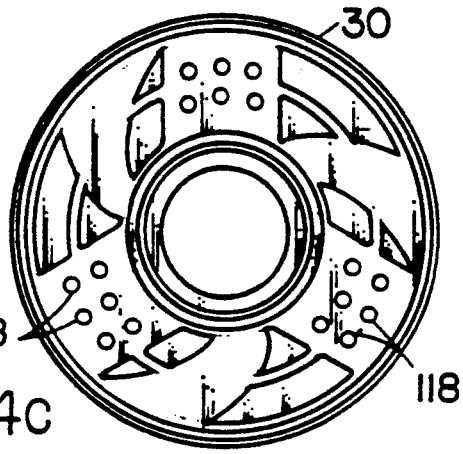
FIG. 4C
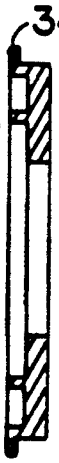
FIG. 5B
FIG. 5A
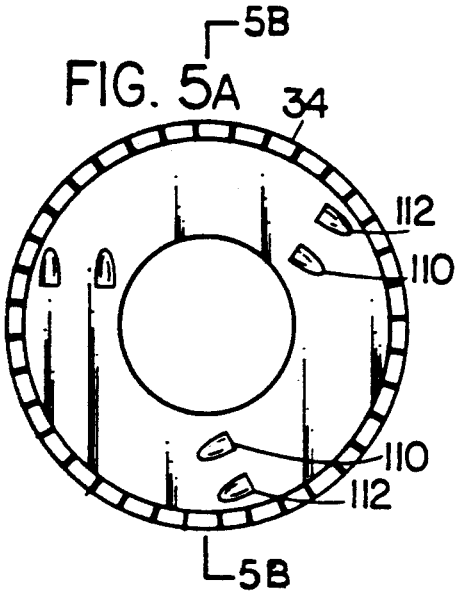
FIG. 5C
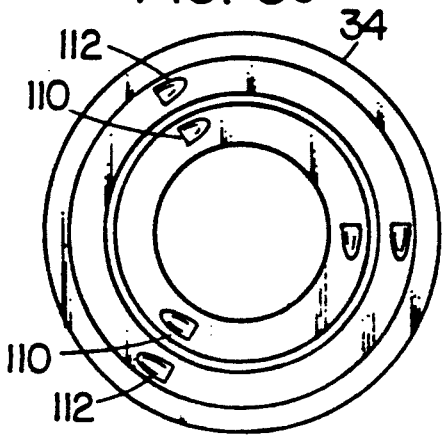

SHOWERHEAD

This application is a continuation-in-part of U.S. application Ser. No. 07/747,742, filed Aug. 20, 1991 now abandoned by the same inventorship and assigned to same assignee.

The present invention relates to showerheads. Although including one or more features generally useful in showerheads, it pertains particularly to multi-mode showerheads having different combinations of continuous spray and pulsating delivery.

U.S. Pat. No. 3,762,648, issued Oct. 2, 1973, disclosed a showerhead which delivered a pulsating stream that could be varied from slow to fast, as distinguished from even earlier showerheads that delivered only continuous sprays which might be adjustable to vary the pattern of delivery. U.S. Pat. No. 3,801,019, issued Apr. 2, 1974, directed attention to a showerhead which allowed selectability as between pulsating and continuous delivery. Its degree of adjustment was from a selection as between fast and slow pulsating delivery and a combination of pulsation together with continuous flow and a reduction in frequency of pulsation as the unit was adjusted toward a mode of all-continuous flow. U.S. Pat. Nos. 3,958,756 and 4,190,207 described showerheads that had characteristic selection as between modes which basically are in the same sequence as in the aforesaid U.S. Pat. No. 3,801,019. Those patents were all based upon design and development over a period of time by the same assignee as that of the present application.

That assignee, besides having very successfully participated in the marketplace for showerheads has continued its prior efforts in research and development with the result of the issuance of still further patents. For example, U.S. Pat. No. 4,303,201 teaches the inclusion of a soft central spray pattern in addition to a more incisive outer spray pattern both combined with the availability of a pulsating flow. It further provides for adjustment to obtain difference from hard to soft in perception of the pulses, as felt on the skin of the user. At the same time, adjustments as between different combinations of the modes permit variation in frequency of the pulsation. One mode available to the user involves an outer spray pattern together with delivery of fairly-hard pulses, while another mode allows the delivery of slow pulses with a soft delivery and a still different mode allows the delivery of fast pulses with a soft characteristic.

U.S. Pat. No. 4,398,669 has a still different combination of features. They include the delivery of either an outer spray or a central spray, or a combination of the two, together with the delivery of pulses which may be fast or slow. A separate shutter element is required to achieve pulse perception at the skin of the unit.

Still another patent is U.S. Pat. No. 4,588,130 which is directed to a showerhead that includes a different and new mode of operation not presented in the showerheads of any of the above patents. While it includes many of the beneficial features of those prior showerheads, it has the additional combination of a continuous spray with an associated slowly pulsating spray so as to yield a comfortable and desirable result as sensed on the skin of the user. As with all of the other showerhead patents mentioned above, this further patent was assigned to the same assignee as is the present application.

For the great majority of users, different ones of the aforegoing showerheads have been proved in use to be both enjoyable and beneficial as well as being reliable and yet reasonably economical. Some users, especially in certain limited geographic areas have, however, experienced ultimate difficulty in operation arising from the deposit of certain minerals on various surfaces of the showerhead. Those minerals arrive within the showerhead by way of the user's water system. Not only do such mineral deposits on the external front surface of the unit detract from an otherwise nice appearance but they tend to clog the orifices. Such clogging may lead to disruption in the desired spray pattern and in some cases even to complete blockage of different ones of those orifices.

It is, therefore, one general object of the present invention to provide a new and improved showerhead in which such difficulties and disadvantages are overcome or at least greatly minimized.

A related object of the present invention is to provide a new and improved showerhead in which a critical component of the showerhead in terms of spray formation may be easily removed from the showerhead for cleaning and restoration of free-flow through the different spray orifices.

A correlated object of the present invention is to provide such a showerhead wherein the removal of a component for cleaning and its ultimate reattachment to the unit may be accomplished without any opportunity for damage to other operative components of the unit.

A different object of the present invention is to achieve a new and better component arrangement for selecting among the different modes of operation and for creating the pulsating sprays when selected.

Another related object of the present invention is to mold critical components of the showerhead from a specific material which has been discovered to be highly resistant to the formation of mineral deposits and with respect to which any such deposits may be removed with but minimal effort.

A further object of the present invention is to provide a new and useful modular concept to achieve the formation of a showerhead which has a core valve assembly from which, with the addition of various components, the production of more than one product model can be achieved.

A still further object of the present invention is to provide a new and improved showerhead which may emit a spray pattern configured generally in correspondence with the outline of the human body.

In accordance with one aspect of the present invention a showerhead has a circular array of outlet orifices defined by a plurality of longitudinal grooves circumferentially-spaced in succession around a cylindrical wall and a ring having a cylindrical lip overlying said grooves with said ring being threadably secured to said showerhead by an annular member for enabling temporary removal of said lip from said showerhead for cleaning.

In another aspect, a channel plate in said showerhead has radially-spaced first and second nozzles individually selectable to effect driving an associated water-chopping turbine at different speeds.

In a further aspect, a rotatable external control ring is coupled through an internal swingable control arm to a control plate the rotational position of which determines the choice of spray mode from the showerhead.

In yet another aspect of the present invention, a showerhead has as one spray pattern a series of circularly-spaced outlets having individually different outlet spacings and inclinations to a common axis as to configure the pattern generally into an oval shape.

The features of the present invention which are believed to be patentable are set forth with particularity in the appended claims. The organization and manner of operation of two specific embodiments of the invention, together with further objects and advantages thereof, may best be understood by reference to the following description taken in connection with the accompanying drawings, in the several figures of which like numerals identify like elements, and in which:

FIG. 4A is a front plan view of a component shown in FIGS. 2 and 3, FIG. 4B is a cross-sectional view taken along the line 4B—4B in FIG. 4A and FIG. 4C is a rear plan view of that same component;

FIG. 5A is a front plan view of another component shown in FIGS. 2 and 3, FIG. 5B is a cross-sectional view taken along the line 5B—5B in FIG. 5A and FIG. 5C is a rear plan view of the same component;

Figure 1:
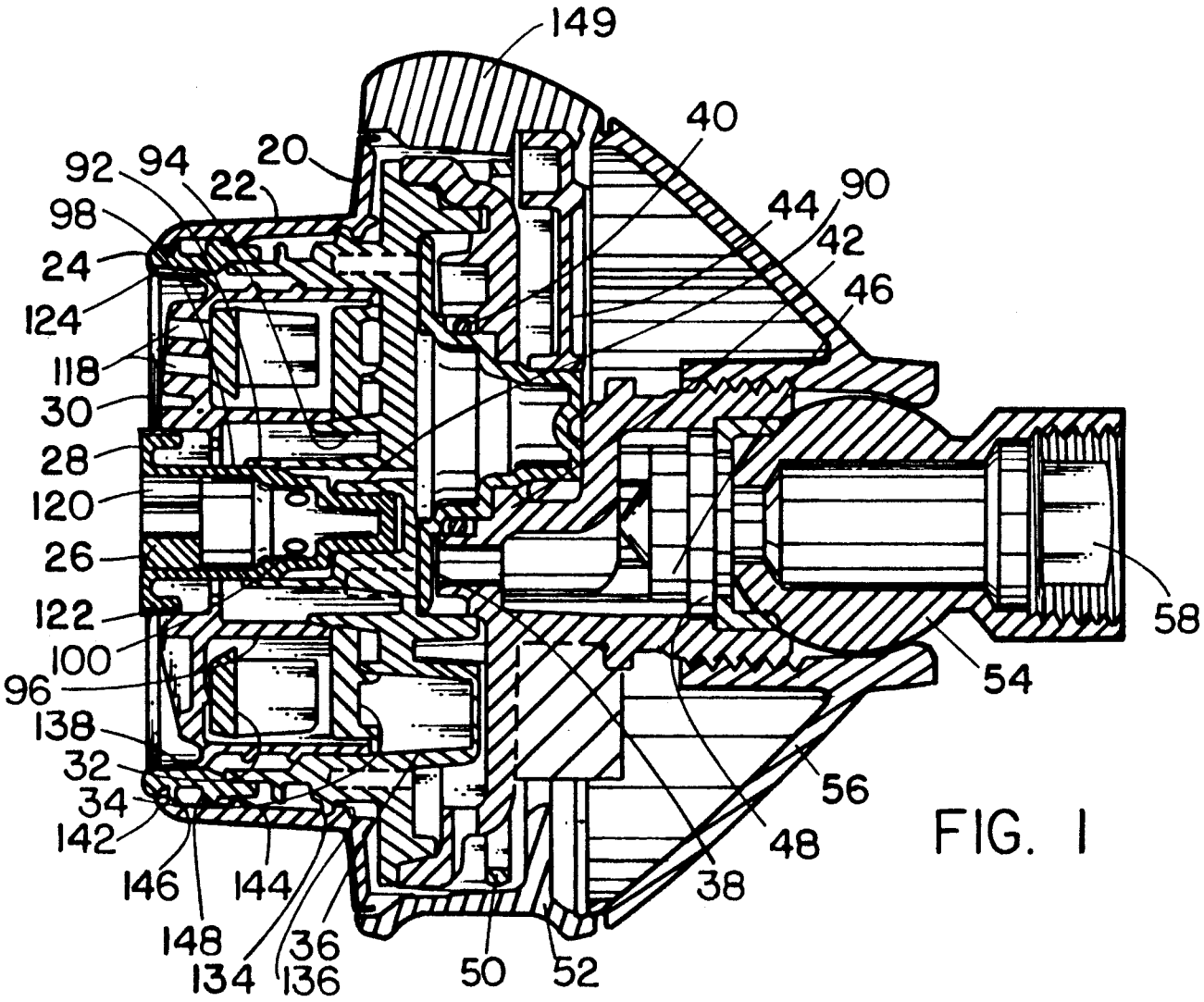
FIG. 1 is a cross-sectional view taken longitudinally through a showerhead embodying the present invention.
Figure 2A:
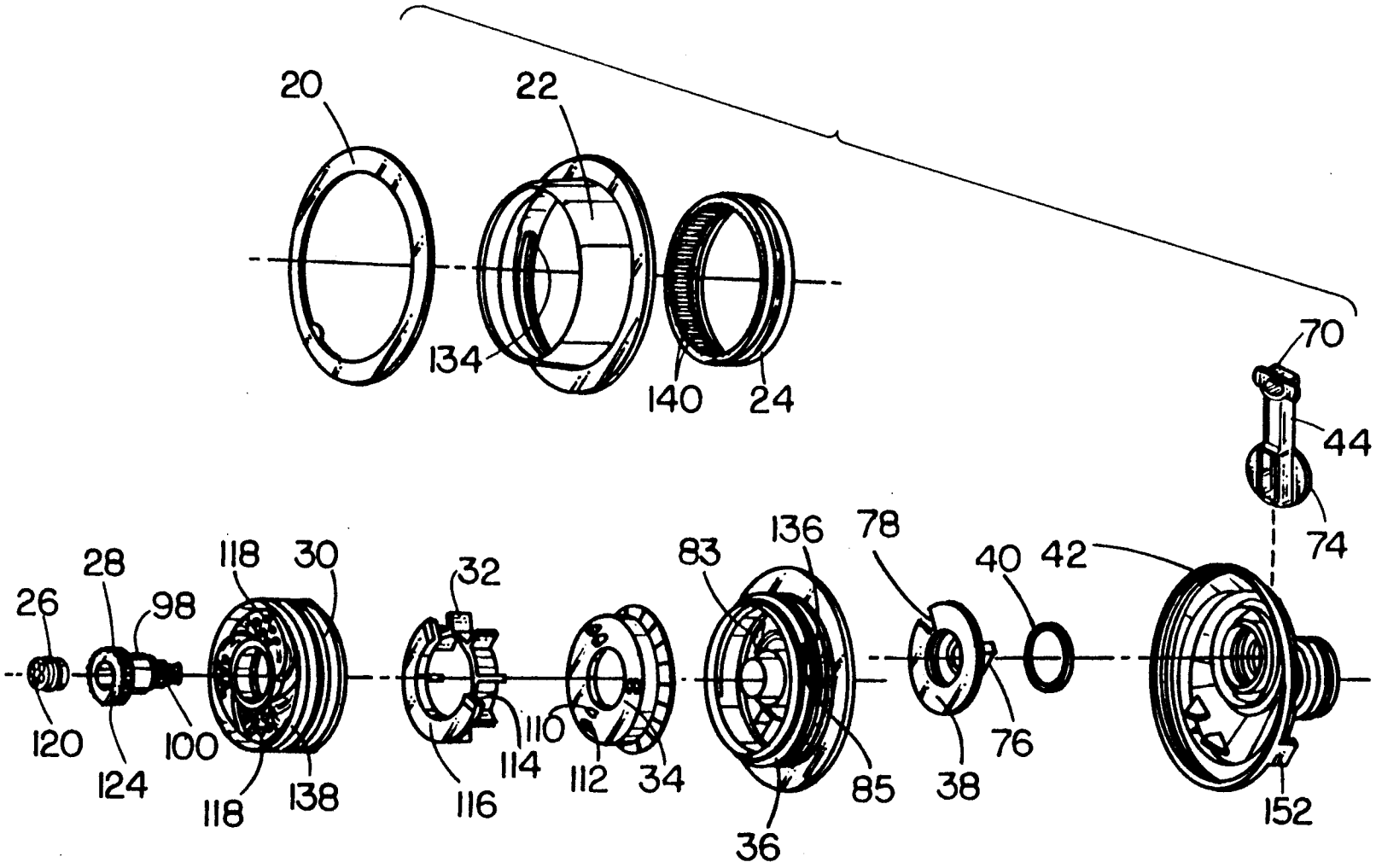
FIG. 2A is an exploded isometric view of a portion of the showerhead of FIG. 1.
Figure 2B:
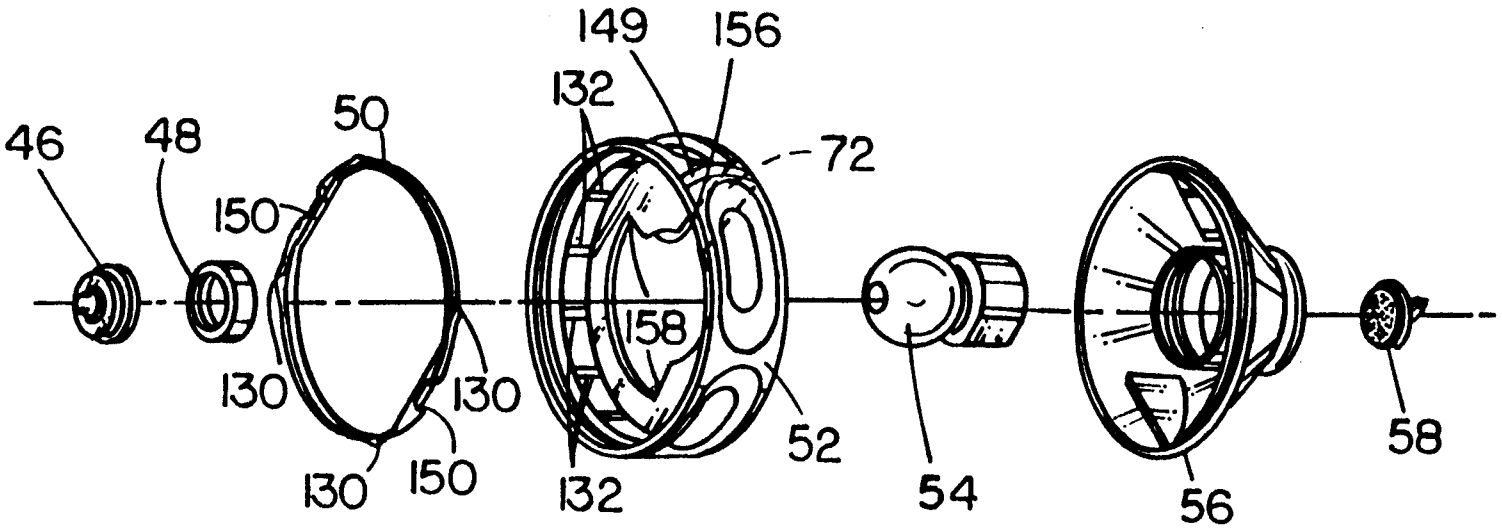
FIG. 2B is an exploded isometric view of the remaining portion of the showerhead of FIG. 1 taken as a continuation of FIG. 2A.

With reference to FIGS. 1, 2A and 2B the various individual components are generally assigned nomenclature which is usually indicative of function. Thus, there is a nameplate 20, a spray cup 22, a spray ring 24, a pause insert 26 and a center spray plug 28 all associated with an orifice cup 30. Internally is a turbine 32, a channel plate 34, a flow director 36 and a control plate 38. Beyond the latter is an O-ring 40, a connecting tube 42, a control arm 44, a flow regulator 46 and a seal 48. Also included is a detent ring 50, a control ring 52, a pivot ball 54, a base cone 56 and a filter screen 58.

Figure 3:
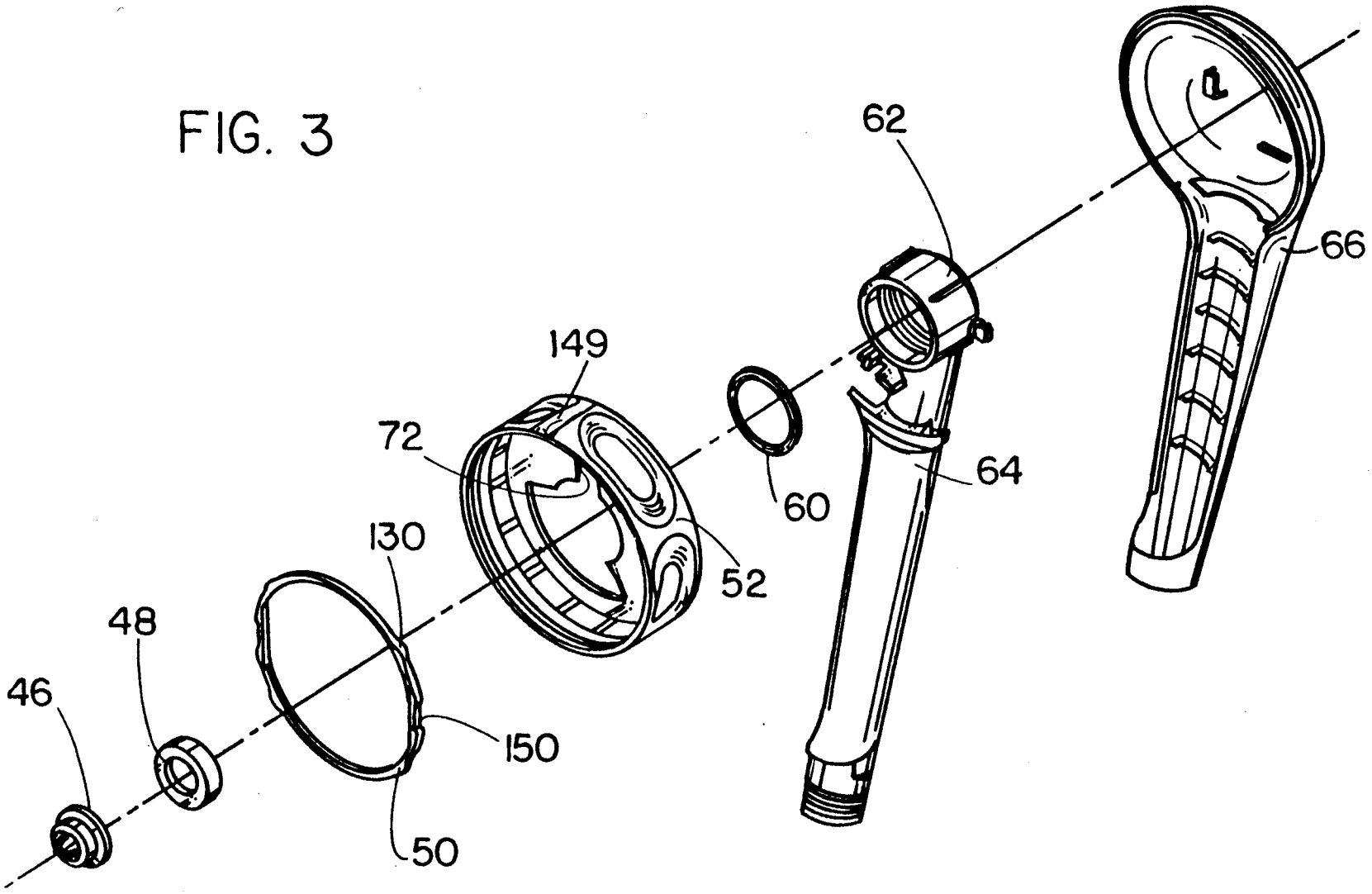
FIG. 3 is an exploded isometric view of an alternative portion of FIG. 2 to accommodate a different manner of mounting.

FIGS. 2A and 2B illustrate a wall-mount version. This is intended to be threaded onto the end of the usual plumbing pipe which projects outwardly from the wall above a bathtub or shower-stall floor. In the alternative hand-held version of FIG. 3, pivot ball 54 and base cone 56 are replaced by another O-ring 60 seated into one end of a handle 64 closed by a back cover 66. In an alternative, handle 64 and cover 66 are combined as molded by a co-injection process which produces finger-depressions on the front handle surface.

Figure 6A:
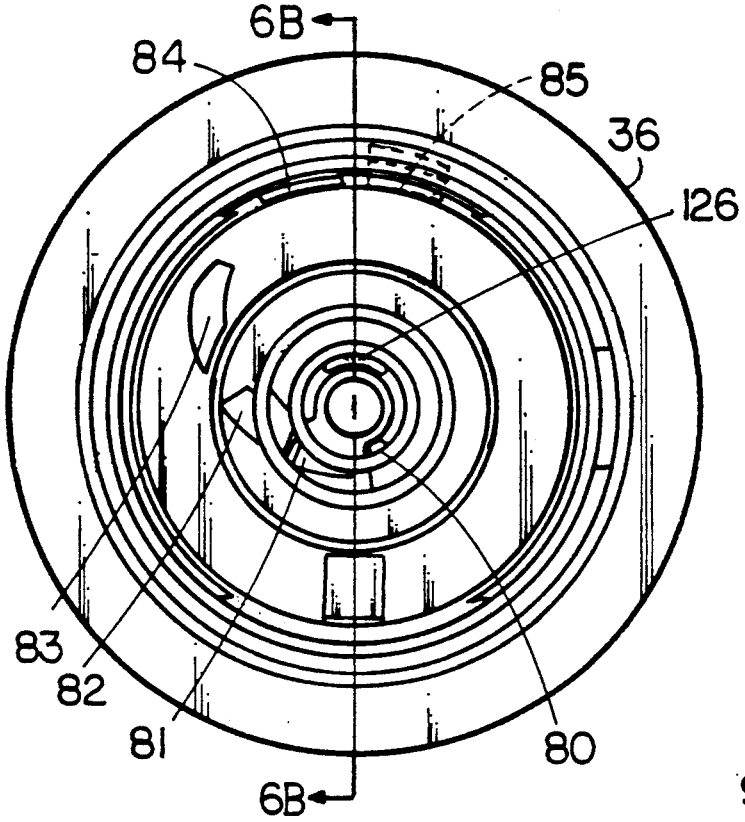
FIG. 6A is a front plan view of a further component shown in FIGS. 2 and 3.
Figure 6B:
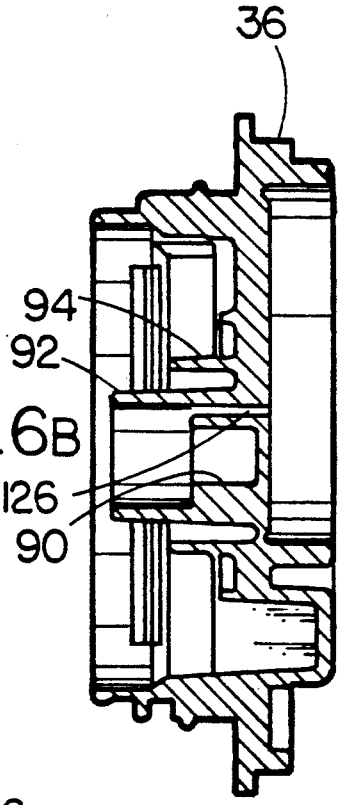
FIG. 6B is a cross-sectional view taken along the line 6B—6B of FIG. 6A
Figure 6C:
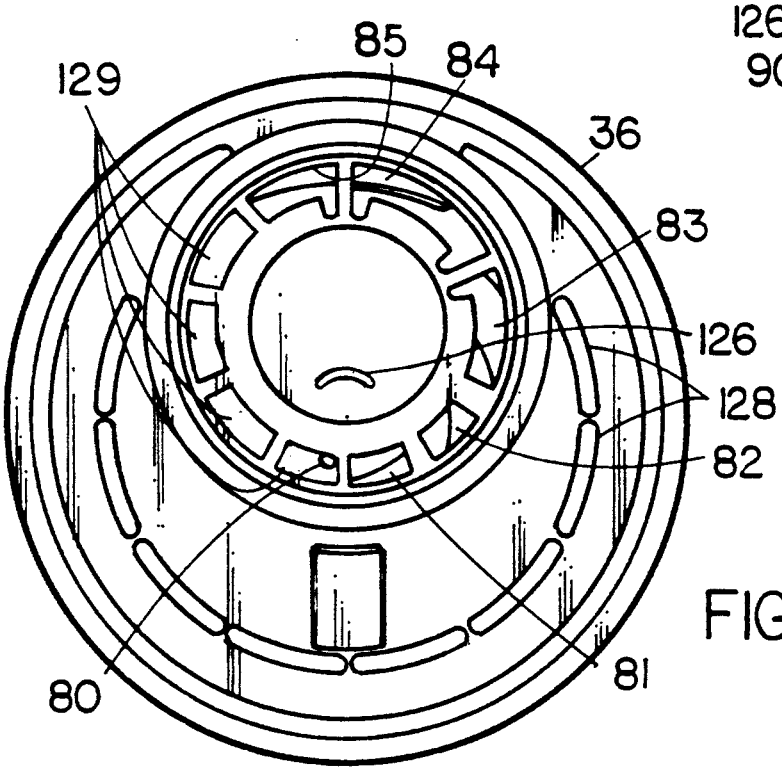
FIG. 6C is a rear plan view of the same component.
Figure 7A:
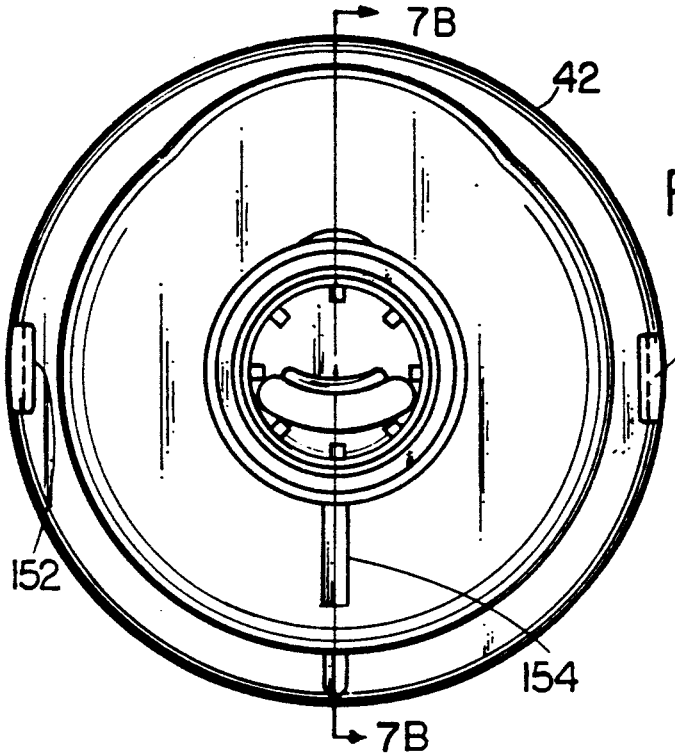
FIG. 7A is a rear plan view of still another component of FIGS. 2 and 3.
Figure 7B:
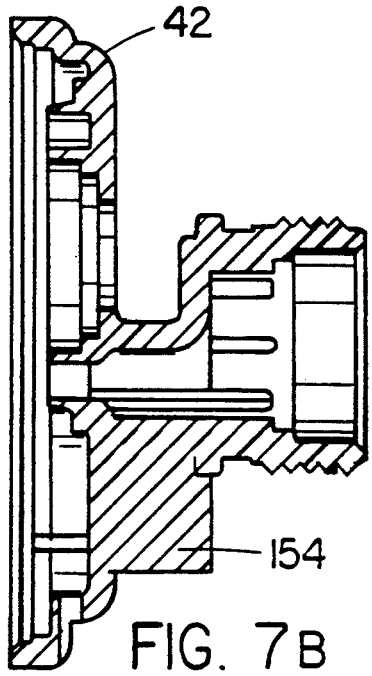
FIG. 7B is a cross sectional view taken along the line 7B—7B in FIG. 7A
Figure 7C:
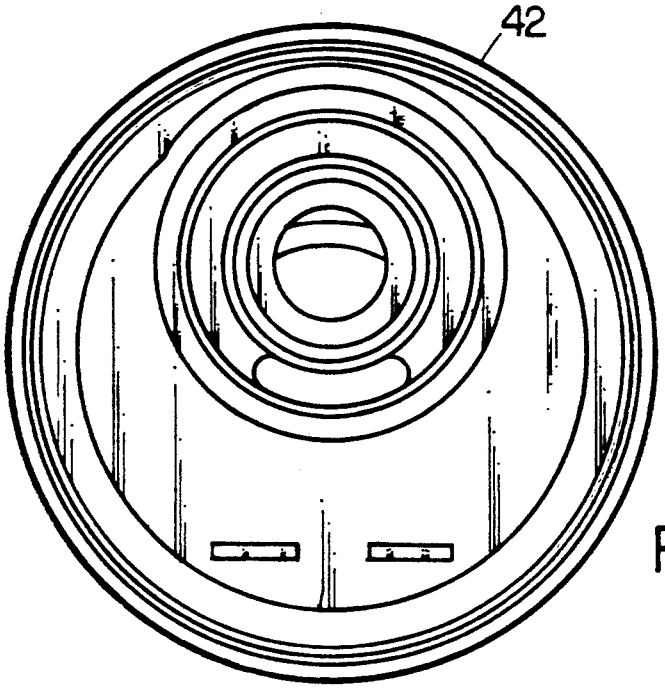
FIG. 7C is a front plan view of the same component.

The key-shaped outer end 70 of control arm 44 is captivated in a slot 72 in the back of control ring 52 so as to be swung a limited distance when the control ring is rotated. The inner end 74 of control arm 44 is secured on a nub 76 of control plate 38. Control plate 38 is thus rotatable so as to move its peripheral notch 78 successively over a plurality of different ports 80–85 in flow director 36 (FIGS. 6A–C).

Port 80 is merely a generally-central hole through director 36. Ports 81–85 as viewed in FIG. 6C are each in the form of an arcuate well having a distinctly shaped contour of bottom opening as depicted with the corresponding number in FIG. 6A. The respective different locations of those openings determine the flow path or paths served as defined by nested sleeves 90, 92 and 94 which project forwardly from director 36 in cooperation with sleeve 96 that projects to the rear from orifice cup 30 and the outer body wall 98 of center spray 28 laterally through which are openings 100 that lead to pause insert 26.

As best seen in FIG. 1, other sleeve-like or circular-rib formations projecting from the different principal components serve to interfit different ones of the components. Thus the rear of orifice cup 30 nests within the forward inner wall of director 36 and rearwardly-projecting short sleeves on channel plate 34 interfit with forwardly-projecting sleeves on director 36. A stepped rearward-sleeve on director 36 nests within a matching outer forward sleeve on connecting tube 42 with those sleeves preferably being welded together ultrasonically in captivation of control plate 38 and O-ring 40.

When notch 78 is over any given one of ports 80–85, a flow path is created through the unit by corresponding passages so as to lead the water to respective ones of the different flow outlets. Water flowing in the flow path through port 82 to nozzle openings 110 in channel plate 34 drives turbine 32 at a first velocity, while when the flow path is from port 83 to outer nozzles 112 the speed of turbine rotation is faster. As with the showerheads in the older patents mentioned above, the water continuing forwardly from turbine 32 is caused to pulsate by reason of the gap 114 in its shoe 116 so that the water pulses are emitted in circumferential succession from the clusters of pulse spray outlets 118 in orifice cup 30.

More particularly for the illustrated embodiment, the port assignments are port 80 for the pause mode wherein a small water stream is emitted from central openings 120, port 81 for the center spray pattern from orifices 122 defined by grooves 124 on center spray plug 28, port 82 for slow pulses and port 83 for fast pulses with both modes delivered from outlets 118 and port 84 for the outer spray from orifices 124. Port 85 is to allow, from the same valve assembly, flow to the body spray outlet pattern described hereinafter.

A central small opening 126 through director 36 allows pressure bleed to permit tight seating of control plate 38. A series of arcuate wells 128 in the rear of director 36 serve merely as a molding relief. Similarly, succeeding ports 80–85 are additional wells 129 which in this case have closed bottoms. To adapt the same core valve assembly for use with a still further flow pattern, one or more of wells 129 may be opened.

Figure 8:
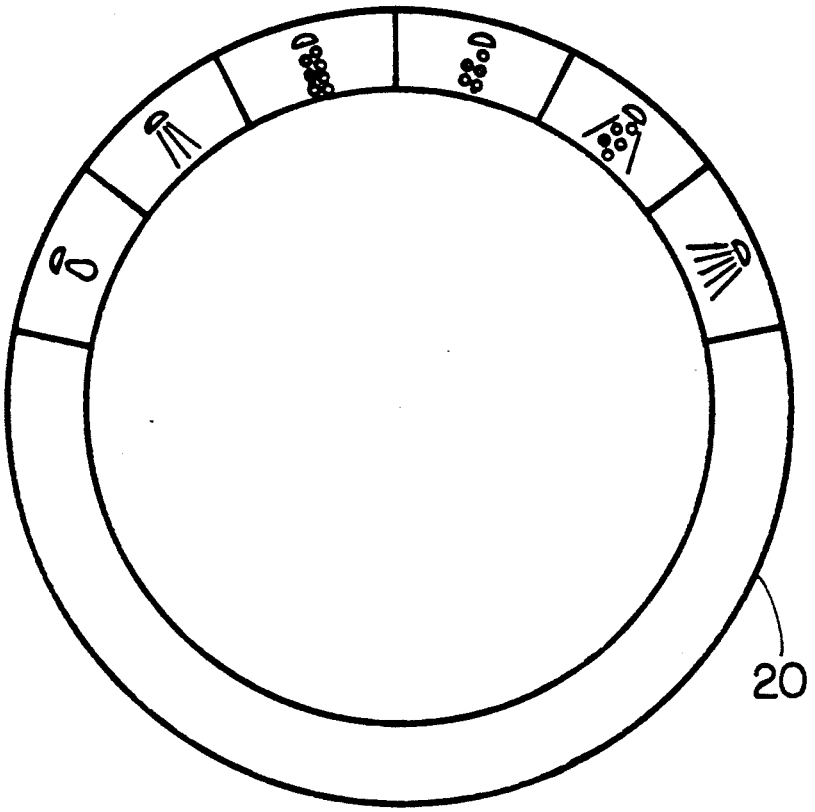
FIG. 8 is a front plan view of yet another component shown in FIGS. 2 and 3.

Resilient detent ring 50 is captivated on the back of connecting tube 42 and located inside control ring 52. As ring 52 is rotated, circumferentially-spaced outwardly-projecting nubs 130 on detent ring 50 are detented successively in longitudinal grooves 132 for each of the different positions generally corresponding respectively to the series of ports in the flow director. This enables the showerhead to deliver the various different spray patterns selectively as graphically depicted in FIG. 8.

More specifically as embodied herein, ports 83 and 84 are elongated while grooves 132 are equally spaced. That results in one detent for a combined outer spray and pulse mode and, after a mode for outer spray alone, a combined outside spray and body spray when the latter mode is included.

On the inner circumferential surface or wall of spray cup 22 is a thread 134 which mates with a corresponding thread 136 on the exterior circumferential surface of director 36. Orifice cup 30 has a forwardly facing lip 138. Spray ring 24 is pressed over lip 138 so that its circumferentially-spaced series of alternating-angle grooves 140 create a continuous-spray circular pattern of orifices 124. Whenever mineral deposits or other contaminents begin to clog the outlet spray pattern, the user is able upon a mere twist to remove spray cup 22 and spray ring 24 so as thoroughly to clean the surface of lip 138 as well as to remove all matter deposited in the spray-defining grooves 140.

As best seen in FIG. 1, the forward end of spray cup or member 22 is in-turned or undercut to form a circular nub 142. Spaced axially to the rear toward thread 134 is a circular nub 144 that protrudes radially inward. From the radially outward exterior surface of spray ring 24 protrudes an axially spaced pair of circular ribs 146 and 148 which together nest between nubs 142 and 144 so that spray ring 24 is captivated within spray cup 22. When the user unthreads spray cup 22 from orifice cup 30, spray ring 24 is pulled outwardly and removed from its operative position wherein grooves 140 overlie lip 138.

In further minimization of the deposit of undesired matter, the material from which at least spray ring 24 and orifice cup 30 are molded preferably is an acetal copolymer as manufactured by Hoechst Celanese Corporation and sold under its trademark CELCON. Desirably all operative components in the flow path are molded of that same material because of its surface resistance to deposits.

The core valve assembly may be described as a multiported valve assembly which includes connecting tube 42, flow director 36, control plate 38, control arm 44, and one seal 40 between the control plate 38 and connecting tube 42. The functional spray patterns (modes) produced by the addition of various combinations of parts are reviewed and listed below.

1. The Pause mode: This mode of shower operation is designed to allow the user to reduce the flow of water without completely shutting off the unit.

2. The Center Spray mode: This provides a concentrated spray pattern consisting of forty individual streams in the form of four concentric circles containing ten spray streams each.

3. The Pulse (massage) mode: This mode is very similar to the slow massage mode in U.S. Pat. Nos. 3,801,019 and 4,190,207. The primary difference is in the way the slower forced vortex is achieved without increasing the flow balance of the unit. This is described in detail below in the discussion of channel plate 34.

4. The Turbo-Pulse (fast massage) mode: This mode is very similar to the fast massage in U.S. Pat. No. 4,398,669. The primary difference is in the way the forced vortex is achieved as also described in detail below in the discussion of channel plate 34.

5. The Combination Pulse/Needle Spray mode: This mode is a blending of two modes with enough flow to each to give pleasing results while maintaining the flow balance of the unit. The flow balance is achieved by precise features in flow director 36 at the properly indexed location that lines up with control plate 38 opening 78 when positioned by external control ring 52.

6. The Needle Spray mode: This mode is basically the same sixty-slot spray pattern as found on the showerhead of U.S. Pat. No. 4,190,207. Although the diameter of the two thirty-slot concentric spray rings is smaller, the angles of the slots remain the same—two degrees and five degrees angled outwardly.

7. The combination Needle Spray/Body Spray mode: This totally new combination of spray patterns is meant to produce a soft blending of a new Body Spray (described below) and the old Needle Spray. Like the Combination Pulse/Needle Spray, each spray receives enough flow to give pleasing results while maintaining the flow balance of the unit. The flow balance is achieved by precise features in flow director 36 at the proper indexed location that lines up with control plate 38 opening 78 when positioned by external control ring 52.

8. The Body Spray mode: This oval/full-body spray pattern is formed by multiple, angled slots of a sixty-slot spray pattern. The oval/full-body spray effect (as opposed to circular concentric rings) is accomplished by varying the slot angle on each of the fifteen slots in each of the four quadrants to produce the desired effect. The desired pattern is described at some optimum distance from the face of the showerhead that would represent the average distance of the body during a normal shower sequence.

The initial combination of components has been selected to produce a pipe mount and a hand-held unit with modes 1 through 6 listed above. Many model variations could be produced by selecting various groups of modes; e.g., a four-mode unit consisting of modes 3 through 6. In addition to having all of the different spray modes fully implemented in the specific embodiment of FIGS. 1–8, the above discussed oval or body-spray mode is more fully included in the alternative embodiment of FIGS. 9 and 10.

Other specific features include the reduction in size (cross-sectional area) of the main valve chamber. This reduced size lowers the force developed by the back pressure created by the valving combination of control plate 38 and the exit ports of flow director 36. This reduction in force creates a stronger unit while maintaining a relatively large diameter face to produce a pleasing variety of spray patterns.

The unique placement and size of the main valve chamber allows the shutter type valve to control the flow to various positions that can be directly ported into a wide variety of spray patterns. Control ring 52 is designed to limit the travel of control arm 44 and, therefore, the number of spray modes that can be selected.

The use of the direct connection between control plate 38 and control arm 44, which in turn is allowed to slide in keyed slot 72 in control ring 52, allows a mode indicator 149, which is molded into control ring 52, to always be indexed in a fixed rotational relationship to the completed unit assembly. This indexed relationship in turn allows mode indicator 149 to be aligned with the graphical images that may be printed or molded onto other components of the assembly. These graphical images each depict a functional mode indicating to the user of the shower which position to set the mode indicator by rotating control ring 52.

The inclusion of the detent feature, which acts in conjunction with the indexed locations of control ring 52 and resulting alignment with the graphical images, adds a tactile and audible feedback to the user when selecting the desired functional mode. This is accomplished with the addition of detent ring 50. This component is designed in such a manner that it is affixed and keyed to the core valve assembly through notches 150 which mate with shoulders 152 on connecting tube 42. A plate 154 projects from the rear of connecting tube 42 to ride within an opening 156 defined in the rear wall of control ring 52 and formed to have oppositely-facing stops 158 to limit the extent of rotation of control ring 52. Consequently, rotational movement of gap 78 in control plate 38 likewise is limited in extent.

As mentioned above, detent ring 50 is also designed in such a manner that the raised semicircular protrusions or nubs 130 on the outer perimeter of the ring will align with corresponding semicircular grooves 132 on the inside diameter of control ring 52. The action of detent ring 50 is such that as control ring 52 rotates the semicircular protrusions 130 of detent ring 50 are pushed inward and result in the deflection of detent ring 50 in a spring-like manner. As control ring 52 reaches the next indexed location, the semicircular protrusions of detent ring 50 are urged into the semicircular grooves on the inside diameter of control ring 52, which results in a physical snap action that can be felt by the user and an audible sound that gives sensory reinforcement that the action is complete.

The design of channel plate 34 as disclosed provides an improved method of achieving multiple turbine speeds while helping to maintain a constant volume of fluid flow through the unit. As shown in the description of the functional spray modes, each pulsating massage mode is driven by its own set of jetted nozzles. Each set of jetted nozzles is placed on individual radial centerlines, thus impinging their flow and direction on the forced vortex of the pulsed mode with a resulting difference in speed but relatively identical flows. The improvement over earlier designs is in the maintenance of a consistent pressure drop controlled by the flow passage cross-sectional area while creating a change in vortex speed solely by the positioning of the jetted nozzles.

Figure 9:
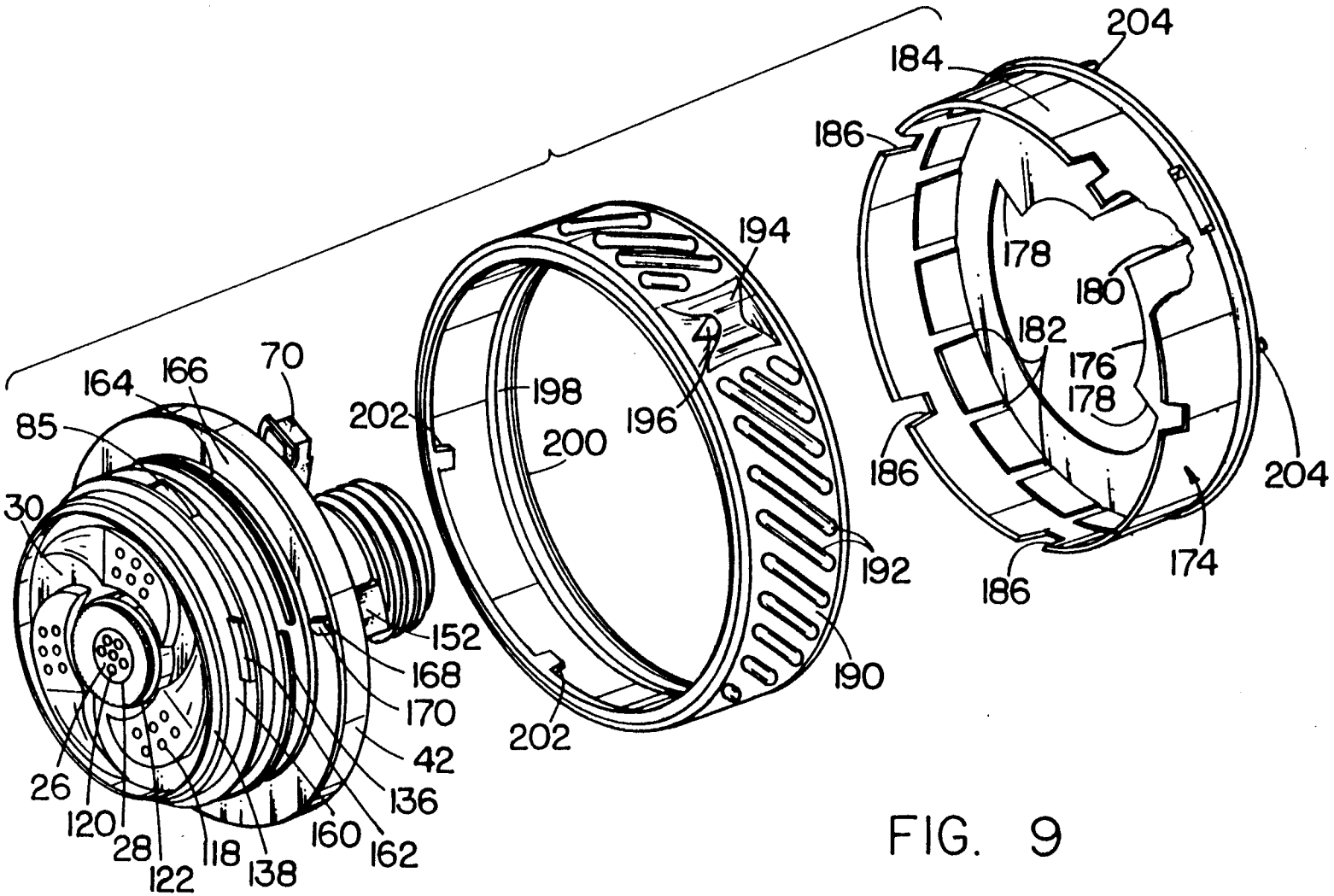
FIG. 9 is an exploded isometric view of a first portion of an alternative embodiment of a showerhead.
Figure 10:
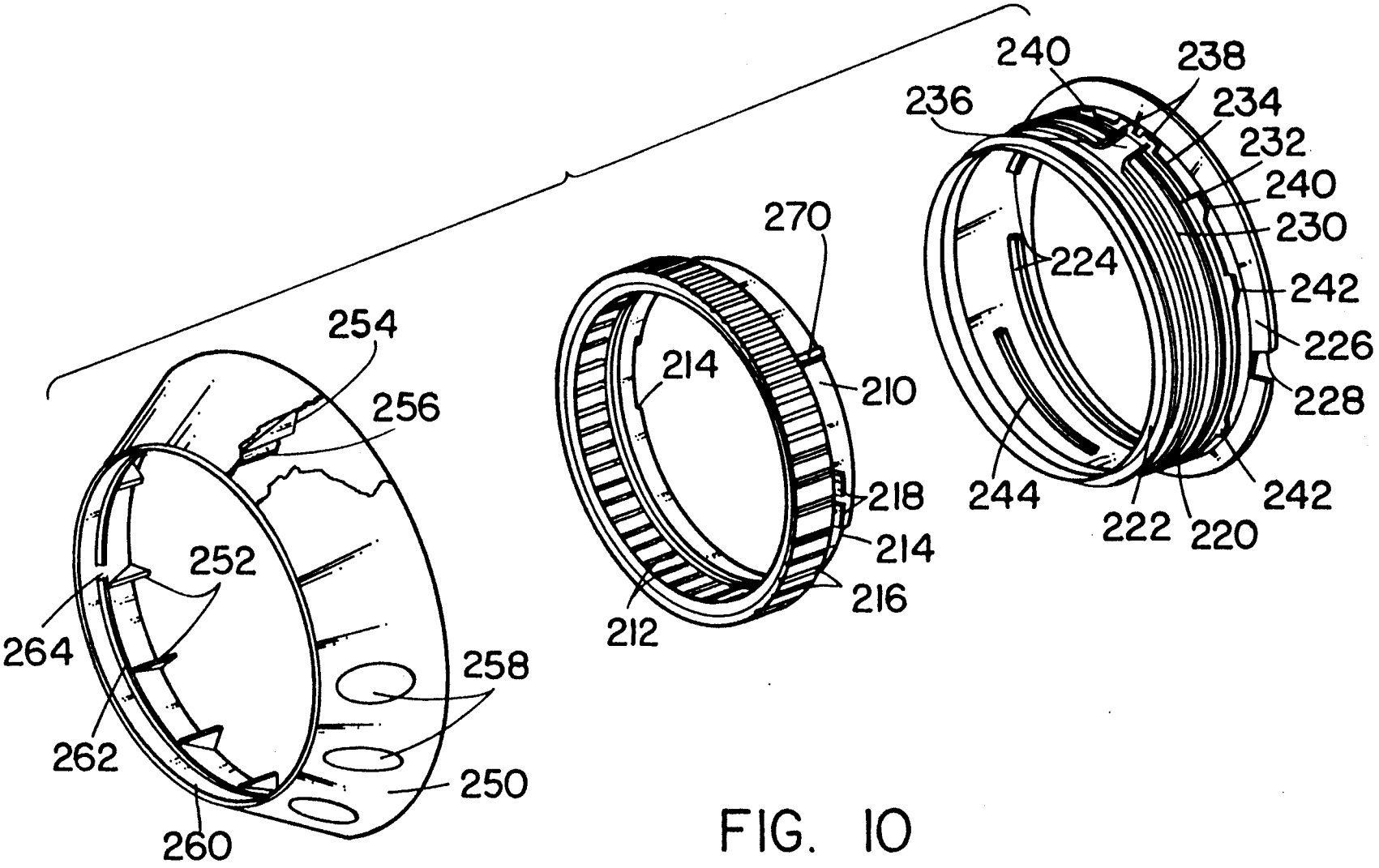
FIG. 10 is an exploded isometric view of the remaining portion of the showerhead of FIG. 9 taken as a continuation of FIG. 9.
Figure 12:
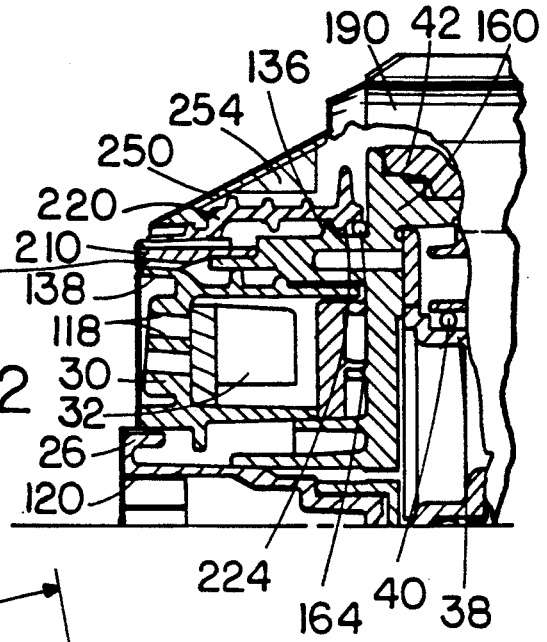
FIG. 12 is a fragmentary cross-sectional view similar in part to FIG. 1 but modified in accordance with the alternative embodiment of FIGS. 9 and 10.

Turning now more fully to the alternative embodiment shown in FIGS. 9 and 10, orifice cup 30 remains the same as before and when assembled includes pause element 26 with its pulse spray outlets 120, central spray plug 28 the circumference of which defines outlets 122 and pulsating spray outlets 118. Projecting forwardly from orifice cup 30 again is lip 138 which forms one side of the continuous spray outlets 124. Also captivated internally are turbine 32 and channel plate 34.

Flow director 160 internally is the same as flow director 36. It specifically includes ports 80–85 and otherwise serves to define the different flow paths the same as previously shown and described. As before a single turn thread 136 is defined on the exterior circumferential surface of director 160 and port 85 exits laterally to one side of that surface.

Projecting radially outward from the same exterior surface are a pair of diametrically-opposed shoulders 162 about which further reference will be made later. An O-ring 164 is seated at the rear on the exterior circumferential surface of director 160 adjacent to its radially-projecting rear flange 166. Projecting axially forward from flange 166 at its periphery are a diametrically-opposed pair of lugs 168 each presenting rearwardly a ramp 170 which also will be mentioned again later.

Also as before, flow director 160 is joined to connecting tube 42 which includes rearwardly-directed shoulders 152. Just visable to one side is the key-shaped one end 70 of control arm 44.

Seated from the rear on connecting tube 42 is a control ring 174 in the rear wall of which is a central opening 176 which defines as its circumferential limits stops 178 and to one side of which is formed a slot 180. Slot 180 as in the case of slot 72 forms a keyway in which rides outer end 70 of control arm 44. Also as before, circumferentially distributed around the interior side wall of control ring 174 is a series of grooves 182 which in use cooperate with nubs 130 on the detent ring in the same manner as previously described. Formed inwardly into the circumferential wall 184 of ring 174 are a series of circumferentially-spaced notches 186. At least one pair of notches 186 are spaced apart circumferentially more than the circumferential spacing between others of the notches for a purpose which will appear later.

Frictionally secured around control ring 174 is a band 190 of a soft, resilient material. Its exterior surface is formed to define a circumferential succession of depressions 192 except at one circumferential location wherein an outwardly projecting ridge 194 is defined. Together with a molded pointer 196, ridge 194 serves in use as an indicator.

Around the rear periphery of band 190 the thickness of the band tapers at 198 to an in-turned rib 200. Circumferentially spaced around the forward internal periphery of band 190 are a circumferentially-spaced series of ears 202. The pattern defined by the spacings of ears 202 is the same as that defined by the spacings of notches 186.

During assembly, band 190 is pressed into place around control ring 174 and oriented so that notches 186 interengage with ears 202. The locations of the respective patterns serve to place ridge 194 and its indicating arrow 196 in a fixed rotational position relative to slot 180. In turn, slot 180 fixes the relationship between the swinging of control arm 44 and the rotational position of gap 78 in control plate 38 which governs the selection of which spray pattern or patterns are operative at any given time. Projecting to the rear from near the periphery of ring 174 are a circumferentially-spaced series of posts 204 which serve to prevent band 190 from rubbing against base cone 56 or handle 64.

Mounted around orifice cup 30 when assembled is a spray ring 210 into the interior wall of which there is defined a circumferentially-spaced succession of grooves 212 which as before serve together with lip 138 to define continuous spray outlets 124. Formed laterally from the rear end into the wall of spray ring 210 are a pair of diametrically-opposed notches 214 which upon assembly are received upon shoulders 162 for the purpose of fixing the rotational alignment of the spray ring.

Circumferentially distributed around the exterior wall of spray ring 210 is another series of grooves 216.

Projecting radially outward from ring 210 are space-opposed pairs of closely-spaced tabs 218. The purpose of tabs 218 is to retain ring 210 within a surrounding collar 220 in the event that continued usage and perhaps excessive water pressure cause the ring to be urged forward.

Beginning in alignment with the space between one pair of tabs 218, the individual spacing between successive pairs of grooves or channels 216 decreases for one-quarter of the length around ring 210 after which that spacing again successively increases to the diametrically-opposite tabs 218. The same pattern is repeated on the opposite side of ring 210 so that the spacing first decreases over another quadrant and then increases over a final quadrant. However, the degree of change is not uniform.

Figure 11:
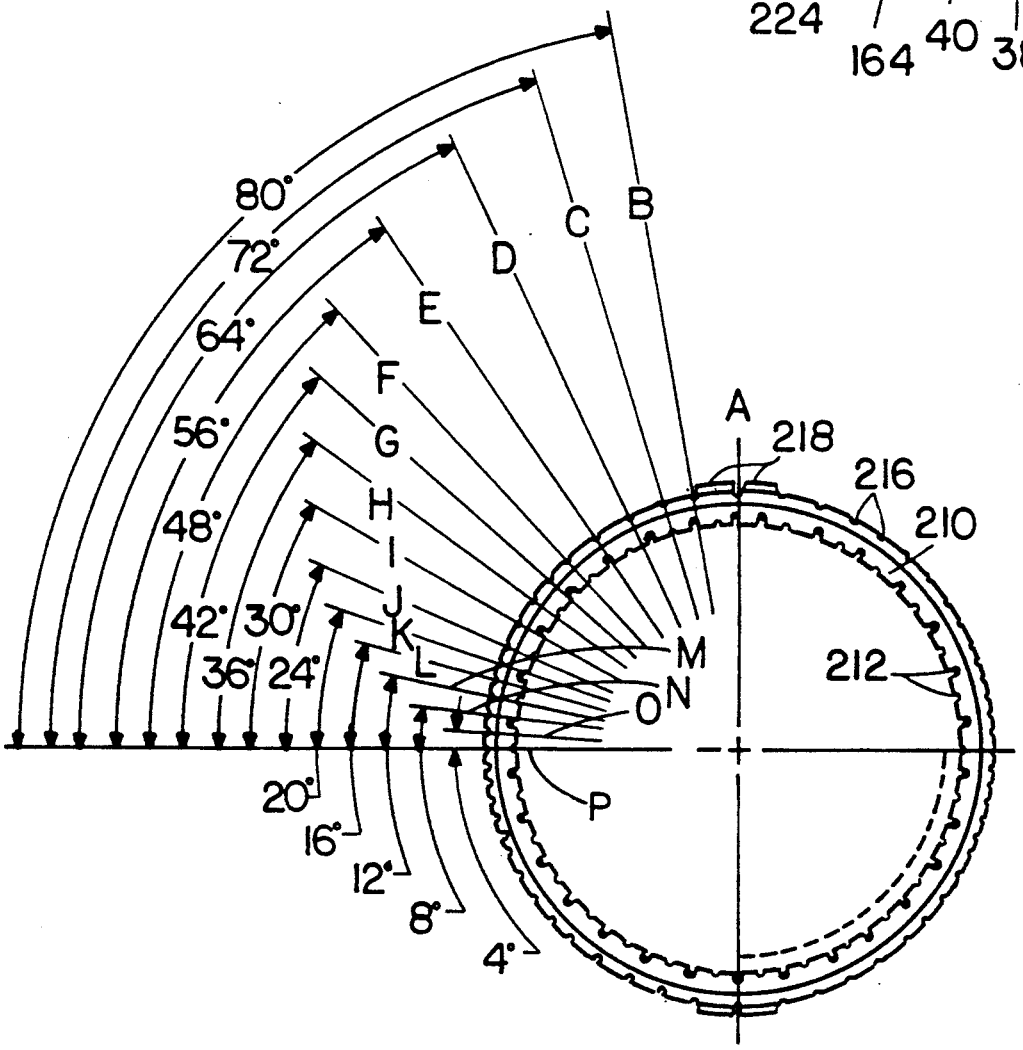
FIG. 11 is a front plan view of a component shown in FIG. 10 together with a graphical depiction of various angular relationships.

As shown in FIG. 11, the preferred differences vary between four degrees with spacing at the tightest to ten degrees as a maximum over sixteen different positions. At the same time, the angle of inclination of each of these different grooves or slots relative to the axial direction is preferably particularized in accordance with the following table:

| ANGLE OF SLOTS |
|---|
| A = 2.75° |
| B = 1.25° |
| C = 3.25° |
| D = 2.00° |
| E = 4.75° |
| F = 3.25° |
| G = 6.75° |
| H = 5.00° |
| I = 9.25° |
| J = 7.25° |
| K = 11.25° |
| L = 9.00° |
| M = 13.25° |
| N = 10.75° |
| O = 14.75° |
| P = 12.00° |

When assembled, spray ring 210 is mounted inside an annular element in the form of collar 220 from which forwardly projects a lip 222 that when assembled overlies grooves 216 in definition of the oval-shaped body spray. That body spray is developed when control arm 44 is swung to align gap 78 with port 85 from which the water emerges and flows into the space defined inside collar 220 in communication with the inner end of grooves 216. Defined on the inner end of collar 220 is a thread 224 which interengages with thread 136 on director 160. Thus, the user may disengage collar 220 from director 160 and spray ring 210 may be also be removed all for the purpose of cleaning those parts including both sets of grooves 212 and 216.

A radially-outward flange 226 at the rear of collar 220 includes a diametrically-opposed pair of notches 228 which, when collar 220 reaches a fully sealed position with respect to O-ring 164, are seated around lugs 168. Axially-spaced from front to rear on the outer surface of collar 220 are three circular ribs 230, 232 and 234 except that short of complete closure rib 230 turns rearwardly at each of facing ends and crosses rib 232 to complete the definition with rib 234 of an entryway 236. Outstanding from rib 234 at the rear end of entryway 236 are a pair of tabs 238. Spaced successively along rib 234 in each direction on each side of tabs 238 are additional tabs 240 and 242. Tabs 242 are tapered downwardly across what would be their upper corners remote from ribs 238. Diametrically opposed on rib 234 are another set of tabs 238, 240 and 242 as a mirror image of the first set but there is in relation to that set no additional entryway.

Surrounding collar 220 is an indicia or nameplate cone 250 which carries in circumferential succession on its outer surface a series of images 258 located in correspondence with the different spray modes as discussed above and as defined by the different possible positions of gap 78 relative to ports 80–85. Circumferentially spaced around the inner wall of cone 250 is a series of axially-oriented webs 252 sized to ride atop ribs 230, 232 and 234 upon assembly. All webs 252 are the same except for one web 254 on the inner edge of which is formed a tongue 256 tapered at its rear end and sized to slide within entryway 236 in order rotationally to position display ring 250 and its images 258 properly with respect to indicator 196 and spray mode selection.

Tabs 238, 240 and 242 serve to supplement tongue 256 in providing anti-rotational strength between cone 250 and collar 220 so that slippage does not occur when collar 220 is unscrewed from director 160. Disposed on the inner wall of collar 220 is a short circular rib segment 244 which serves to supplement the equal distribution of water flow to grooves 216.

The radial side of notches 228 corresponding to the side of lug 168 toward which tapered surface 170 declines also is tapered. Thus, lugs 168 serve as a stop upon tightening but the two tapered or slanting surfaces cause flange 226 to be pried outwardly free of lugs 168 as the user begins to rotate collar 220 in a counter-clock wise direction as viewed from the front. Preferably, the feature afforded by notches 228 and lugs 168 is also incorporated into cone 22 and director 36 of the first embodiment. Moreover, flow director 36 may be exactly the same as flow director 160.

Spaced inwardly from the nose 260 of cone 250 on a rearwardly-directed inner surface is an inward circular rib 262 in which is formed a space-opposed pair of gaps 264. These serve the molding process by providing space for gates. A short rib 270 projects axially to the rear on the outer surface of spray ring 210 beyond grooves 216. It serves the molding process as a thicker place for a gate.

Present day molding techniques have evolved to enable reasonably precise formation of slots or grooves 216 in satisfaction of the intergroove spacings depicted in FIG. 11 and the angles of inclination relative to the axial direction set forth in the table above. Nevertheless, those spacings and angles need only be approximated in order to achieve a generally oval shape of the spray pattern out in front of the showerhead where the user is located.

Grooves 216 together with lip 222 define channels which are distributed around a circular array. That array may be represented as having an interchannel spacing which generally decreases in each direction from a diametrically-opposed pair of reference points which correspond to the spaces between tab pairs 218. The decrease continues for a circular quarter of the array circumference. Also over each circular quarter, the individual angles of inclination relative to the axial direction of the channels generally increases away from the reference points. The result is to define a spray pattern of oval shape at a short distance in front of the showerhead.

The successive spacings and angles of inclination of the different ones of grooves 216 in spray ring 210 in this case serve to define two distinct oval spray patterns with one having a slightly greater degree of divergence away from the axis than the other. As is the case with the inner continuous spray defined by grooves 212, the generation by grooves 216 of two such patterns of similar divergence appears to the user as one pattern of increased thickness as compared with having but one actual pattern. Nevertheless, when desired there may be but one pattern generated to define a sharper oval pattern at the body of the user or there may be the generation of three or more specific patterns to define an even thicker oval pattern as sensed by the user. In any case, the combined effect of the varying inclinations and spacing is to produce an overall spray pattern spaced out in front of the showerhead by a distance of approximately three feet which is oval or elliptical in shape. This is why that mode of operation has been referred to as the body mode.

While particular embodiments of the present invention have been shown and described, and various modifications and alternatives have been mentioned, it will be obvious to those skilled in the art that changes and modifications may be made without departing from the invention in its broader aspects. Therefore, the aim in the appended claims is to cover all such changes and modifications as fall within the true spirit and scope of that which is patentable.

We claim:

1. In a showerhead including a housing having a water inlet and a water outlet spaced from said inlet along a water flow path with said outlet being defined by a circular array of orifices spaced in succession one after another, said outlet comprising:

a cylindrical body having a radially outward exterior surface;

an annular member having a radially inward interior wall;

a ring disposed within and captivated by said annular member with said ring having a radially inward interior surface;

a circular array of grooves oriented to lie in an axial direction and formed into one of said surfaces;

a cylindrical lip projecting in the axial direction from the other of said surfaces to cover said grooves in definition of said orifices;

a first thread formed on said exterior surface;

and a second thread formed on said interior wall and matable with said first thread to removably mount said member and said ring on said body with said lip covering said grooves.

2. A showerhead as defined in claim 1 in which said grooves are formed in said interior surface and said lip projects from said exterior surface.

3. A showerhead as defined in claim 1 in which said body, said lip and said member all are molded from an acetal copolymer.

4. In a showerhead including a water inlet and a water outlet spaced from said inlet along a water flow path with said outlet being defined by a circumferentially-spaced plurality of orifices, a distributor in said flow path comprising:

a turbine rotatable about an axis in said flow path and defining a gap delivering water to successive ones of said orifices as said turbine rotates;

at least one first nozzle in said path and through which water flows in development of a force urging said turbine to rotate with said first nozzle being spaced radially outward a first distance from said axis;

at least one second nozzle in said path and through which water flows in development of a force urging said turbine to rotate with said second nozzle being spaced radially outward from said axis a second distance greater than said first distance;

and an adjustable director assembly in said flow path upstream from said nozzles to direct said water selectively as between said first and second nozzles.

5. In a showerhead including a housing having a water inlet and a water outlet spaced along a water flow path from said inlet with said outlet being defined by at least two different radially-spaced orifice groups, a group selector comprising:

a flow director in said housing through which water flows into a selected one of respective subpaths individually continuing to a corresponding one of said orifice groups;

a control plate in said housing rotatable to select between said subpaths;

a control arm in said housing secured at one end to said control plate to rotate said control plate upon swinging movement of the other end of said arm about said one end;

and a control ring mounted around the exterior of said housing for rotation and coupled to said other end of said control arm to swing said other end as said control ring is rotated.

6. A showerhead as defined in claim 5 which further includes:

a display ring mounted on the exterior of said housing adjacent to said control ring and having a circumferentially-spaced plurality of graphic symbols corresponding to respective ones of said orifice groups;

and an indicator located on said control ring adjacent to said display ring and movable thereby into alignment with different ones of said symbols in correspondence with the selection among said subpaths.

7. A showerhead as defined in claim 5 in which the radially inward surface of said control ring has a plurality of circumferentially-spaced axially-oriented grooves and which further includes a resilient detent ring secured to said flow director and having a series of outwardly-facing circumferentially-spaced nubs detentable in different ones of said grooves in correspondence with selection of different ones of said subpaths.

8. In a showerhead including a housing having a water inlet and a water outlet spaced from said inlet along a water flow path, said outlet comprising:

a cylindrical body disposed centrally within said housing;

a cylindrical first lip projecting in the axial direction from the outer periphery of said body;

a ring having inner and outer surfaces disposed coaxially around said first lip;

a circular first array of grooves oriented to lie in the axial direction and formed into said inner surface in a position to be covered by said first lip in definition of a first circular array of orifices spaced in succession one after another;

a circular second array of grooves oriented to lie in the axial direction and formed into said outer surface of said ring;

a collar disposed beyond said ring;

a cylindrical second lip projecting in the axial direction from the inner periphery of said collar in a position to cover said second array of grooves in definition of a second circular array of orifices spaced in succession one after another;

and an intergroove spacing in said second array generally decreasing from a diametrically-opposed pair of reference points in each direction progressively for a circular quarter of the array circumference and the individual angular inclination relative to the axial direction of the grooves in said second array generally increasing from said reference points over said quarters as to define a spray pattern of oval shape at a predetermined distance in front of said showerhead.

9. In a showerhead including a housing having a water inlet and a water outlet spaced from said inlet along a water flow path with said outlet being defined by a circular array of orifices spaced in succession one after another, said outlet comprising:

a cylindrical body having a radially outward exterior surface;

an annular element having a radially inward interior surface;

a circular array of grooves oriented to lie in an axial direction and formed into one of said surfaces;

a cylindrical lip projecting in the axial direction from the other of said surfaces to cover said grooves in definition of said orifices;

and an intergroove spacing in said array generally decreasing from a diametrically-opposed pair of reference points in each direction progressively for a circular quarter of the array circumference and the individual angular inclination relative to the axial direction of said grooves in said array generally increasing from said reference point over said quarters as to define a spray pattern of oval shape at a predetermined distance in front of said showerhead.

10. In a showerhead including a housing having a water inlet and a water outlet spaced from said inlet along a water flow path with said outlet being defined by a circular array of orifices spaced in succession one after another, said outlet comprising:

a circular array of channels in definition of said orifices with an interchannel spacing in said array generally decreasing from a diametrically-opposed pair of reference points in each direction progressively for a circular quarter of the array circumference and the individual angles of inclination relative to the axial direction of said channels generally increasing from said reference points over said quarters as to define a spray pattern of oval shape at a predetermined distance in front of said showerhead.

11. In a showerhead including a housing having a water inlet and a water outlet spaced from said inlet along a water flow path, said outlet comprising:

a cylindrical body having a radially outward exterior surface;

a ring disposed around said body with said ring having a radially inward interior surface and a radially outward exterior wall;

a circular array of grooves oriented to lie in an axial direction and formed into one of said surfaces;

a first cylindrical lip projecting in the axial direction from the other of said surfaces to cover said grooves in definition of a first group of orifices;

a collar disposed around said ring and having a radially inward interior wall;

a circular array of channels oriented to lie in an axial direction and formed into one of said walls;

a second cylindrical lip projecting in the axial direction from the other of said walls to cover said channels in definition of a second group of orifices;

a first thread formed on said exterior surface;

and a second thread formed on said interior wall and matable with said first thread to removably mount said collar on said body with said lips covering respective ones of said grooves and said channels.

12. In a showerhead including a housing having a water inlet and a water outlet spaced from said inlet along a water flow path, said outlet comprising:

a cylindrical body having a radially outward exterior surface;

a ring disposed around said body with said ring having a radially inward interior surface and a radially outward exterior wall;

a circular array of grooves oriented to lie in an axial direction and formed into one of said surfaces;

a first cylindrical lip projecting in the axial direction from the other of said surfaces to cover said grooves in definition of a first group of orifices;

a collar disposed around said ring and having a radially inward interior wall;

a circular array of channels oriented to lie in an axial direction and formed into one of said walls;

a second cylindrical lip projecting in the axial direction from the other of said walls to cover said channels in definition of a second group of orifices;

a flow director in said housing through which water flows into a selected one of respective subpaths individually continuing to a corresponding one of said orifice groups;

a control plate in said housing rotatable to select between said subpaths;

a control arm in said housing secured at one end to said control plate to rotate said control plate upon swinging movement of the other end of said arm about said one end;

and a control ring mounted around the exterior of said housing for rotation and coupled to said other end of said control arm to swing said other end as said control ring is rotated.

13. A showerhead as defined in claim 12 which still further includes:

a display ring mounted on the exterior of said housing adjacent to said control ring and having a circumferentially-spaced plurality of graphic symbols corresponding to respective ones of said orifice groups;

and an indicator located on said control ring adjacent to said display ring and movable thereby into alignment with different ones of said symbols in correspondence with the selection among said subpaths.

* * * * *